United States Patent [19]

Burnett et al.

[11] 4,037,182

[45] July 19, 1977

[54] MICROWAVE TUNING DEVICE

[75] Inventors: Gary L. Burnett, Anaheim; George I. Tsuda, Fullerton, both of Calif.

[73] Assignee: Hughes Aircraft Company, Culver City, Calif.

[21] Appl. No.: 720,340

[22] Filed: Sept. 3, 1976

[51] Int. Cl.[2] ..... H01P 1/20; H01P 7/00

[52] U.S. Cl. ..... 333/73 R; 333/73 S; 333/73 W; 333/82 B

[58] Field of Search ..... 333/73 R, 73 C, 73 S, 333/73 W, 82 R, 82 A, 82 B

[56] References Cited

U.S. PATENT DOCUMENTS 3,505,618 4/1970 McKee ..... 333/73 R 3,818,389 6/1974 Fisher ..... 333/73 R

*Primary Examiner*—Paul L. Gensler

*Attorney, Agent, or Firm*—Rafael A. Cardenas; W. H. MacAllister

[57] ABSTRACT

A microwave tuning device is disclosed which utilizes a resonator rod mounted in a housing. One end of the resonator rod is attached, or shorted, to the housing wall and the other end is unattached or open. The open end of the resonator rod has a cylindrical recess and an insulator ring is disposed between the open end of the resonator rod and the cavity wall. A tuning screw is incrementally inserted through the insulator ring and into the cylindrical recess for adjusting the tuning capacitance and thereby the resonant frequency.

3 Claims, 2 Drawing Figures

MICROWAVE TUNING DEVICE

BACKGROUND OF THE INVENTION

1. Field of the Invention

This invention relates generally to microwave devices and in particular this invention relates to a tuning means for adjusting the capacitance of a resonator rod in a resonant microwave cavity.

Description of the Prior Art

2. Microwave filters and tunable microwave devices are generally known in the prior art. Various methods of tuning have been utilized and have met with varying degrees of success. Most of the tuning methods heretofore used have been costly to manufacture, assemble, tune, or maintain in a tuned condition.

Microwave devices using resonator rods are also well known in the prior art. The combination of the resonator rod and the resonant cavity presents a resonant element which may be an equivalent inductance or an inductance plus capacitance depending upon the length of the resonator rod. The effective length of the resonator rod may be varied by varying the capacitance between the open end of the rod and the cavity wall. One of the methods that has been used for adjusting the capacitance between the rod and the cavity has been to insert a tuning screw directly opposite the free end of the resonator rod. The capacitance is adjusted by adjusting the spacing between the end of the screw and the end of the rod. Such an arrangement limits the range of capacitance values that can be obtained, however. In addition, the capacitance vlaues of such a device vary greatly with temperature due to the effect of the coefficients of thermal expansion. Another limitation of a cantilevered resonator rod is that under conditions of vibration the resonator rod acts as a tuning fork which results in an unstable resonant frequency.

Another method of providing variable capacitance to a resonator rod is to provide adjustable sides to the resonator cavity. This is accomplished by placing individual adjustable blocks opposite the open end of the resonator rod and adjusting the spacing therebetween for achieving the desired capacitance and the desired resonant frequency. Such an arrangement is costly to manufacture and provides a limited capacitance range and therefore limited tuning capability.

Generally, the methods used heretofore for adjusting the capacitance in a microwave device have been costly due to the high machining tolerances which are required for obtaining high rejection and low losses.

OBJECTS AND SUMMARY OF THE INVENTION

Accordingly, it is an object of the present invention to provide a microwave tuning device that is simple, reliable, and inexpensive to manufacture.

It is another object of the present invention to provide a tunable microwave device that is stable under vibration conditions.

It is still another object of the present invention to provide a microwave tuning device having low RF leakage and low loss.

It is yet another object to provide a microwave tuning device that is easily tuned and has a large range of capacitance values.

In accordance with the foregoing objects a tunable microwave device includes a resonator rod mounted within a housing. The resonator has first and second ends, the first end being mounted to the wall and the second end having a cylindrical recess. An insulating ring is disposed between the second end of the resonator rod and the wall of the housing. A tuning rod is mounted opposite the second end of the resonator rod for incremental insertion into the cylindrical recess for tuning the resonant frequency of the resonator rod.

DETAILED DESCRIPTION OF THE DRAWINGS

Figure 1:
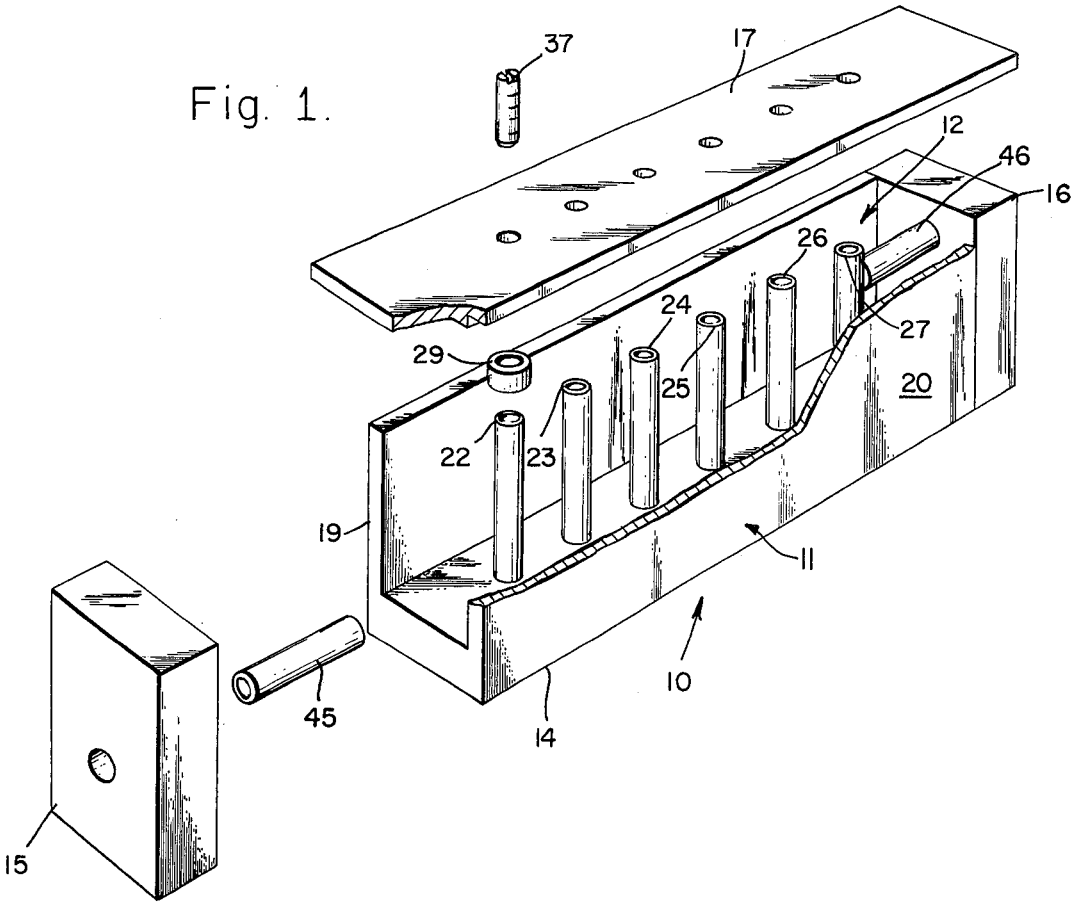
FIG. 1 is an exploded view of a microwave filter utilizing an embodiment of the present invention.

Referring more specifically to FIG. 1, an embodiment of the present invention is illustrated in a rectangular microwave filter 10. The microwave filter 10 includes a housing 11 in a so-called "comb-line" filter configuration 12. The comb-line filter 12 is a number of resonator rods having one end mounted or shorted to the housing 11. The other end of each rod is open or unattached to the housing wall.

The housing 11 includes a chassis 14 with end plates 15 and 16, and a top cover 17. The housing 11 may be manufactured as one piece or as several pieces fastened together by any convenient method such as by screws or soldering. The interior height of the housing is slightly greater than the length of the resonator rods of the filter 12. The distance between walls 19 and 20 may be any convenient dimension such as 0.500 inches but less than that required for higher mode propagation. The length of the housing may be sufficient to accommodate the desired number of resonator rods. The top cover 17 has series threaded holes aligned with the center of the open end of each resonator rod. The end plates 15 and 16 have openings for mounting the input and output connectors, respectively.

The comb-line filter 12 includes a plurality of identical resonator rods 22–27 each of which embodies the principles of the present invention and therefore only one will be described in detail. The number of resonator rods employed for the filter depends upon the desired characteristics of the passband. The resonator rod 22 is mounted to the bottom of the chassis 14 by a fastener, such as a screw, or by soldering. The length of the rod 22 is determined by the desired resonant frequency. Generally in a comb-line filter arrangement the length of the resonator rod is slightly less than one-eighth of a wavelength at the resonant frequency. The diameter of rod 22 is determined by the requisite susceptance. The open end of the rod 22 has a cylindrical recess extending about 0.100 inches into the rod.

Disposed between the resonator rod 22 and the top cover 17 is an alignment ring 29. The ring is made of a dielectric material such as Rexolite made by American Enka Corporation, for example. The alignment ring 29 has the dual function of providing a predetermined capacitance between the resonator rod 22 and the housing wall, and providing mechanical support to the rod 22. A threaded tuning rod 37 extends through the top cover 17, the alignment ring 29, and into the cylindrical recess in the rod 22. The tuning rod 37 may be incrementally inserted into the resonator rod for adjusting the resonant frequency.

The input port illustrated here as a coaxial connector 45 extends through the end plate 14 and mounts directly to the first resonator rod 22. The output port illustrated here as a coaxial connector 46 extends through the end plate 15 and attaches to the resonator rod 27.

Figure 2:
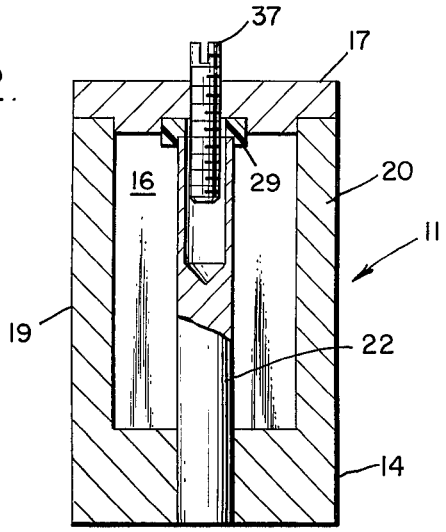
FIG. 2 is a sectional view illustrating a resonator rod utilizing the present invention.

Referring now to FIG. 2, a detailed cross-sectional view of a microwave filter more closely illustrates the invention. The resonator rod 22, shown here without the input connector 45, is mounted or shorted to the bottom of the chassis 14. The top cover 17 is in place over the open end of the resonator rod 22. A threaded hole in the cover 17 is aligned with the axis of the resonator rod 22. Coaxially with the threaded hole the bottom surface of the cover 17 is counter-bored. The outside diameter of the alignment ring 29 fits within the diameter of the counter-bored opening and the resonator rod 22 fits within the inside diameter of the ring 29. Thus the rod 22 is firmly supported at both ends thereby substantially eliminating the tuning fork effect of other open end resonator rods.

The threaded tuning rod 37 is mounted in the threaded opening in the cover 17 and may be incrementally inserted into the resonator rod 22. The inside diameter of the open end of rod 22 is sufficiently greater than the tuning rod 37 diameter such that the two do not touch. The capacitance and, as a consequence, the resonant frequency are varied by the incremental insertion of the tuning rod 37 into the resonator rod 22. Thus, the tuning capacitance of the resonant element may be controlled very closely by the threaded tuning rod 37. Heretofore, prior art methods have provided a limited capacitance range, whereas the present invention provides a greater range. The tuning capacitance range of a filter utilizing the principles of the present invention is several times that of prior art tuning methods.

Although the present invention has been shown and described with reference to particular embodiments, nevertheless, various changes and modifications obvious to one skilled in the art to which the invention pertains are deemed within the purview of the invention. For example, the tunable resonator rod may be utilized in cavities or housings having other configurations such as a circular waveguide member.

What is claimed is:

1. A tunable microwave device, comprising:

housing means having first and second walls;

a resonator rod for providing a predetermined resonance, one end of said resonator rod being mounted to said first wall of said housing means, the second end of said resonator rod having a recess;

alignment means being disposed between the second end of said resonator rod and said second wall of said cavity means for supporting said second end of said resonator rod and for providing capacitance between said resonator rod and said cavity means; and tuning means for providing capacitance being incrementally insertable into said recess in said resonator rod.

2. The invention according to claim 1 wherein said alignment means comprise:

a ring having inside and outside diameters wherein said second end of said resonator rod fits into said inside diameter, said outside diameter of said ring being fitted into said second wall;

said ring being of a dielectric material.

3. A tuning microwave device comprising:

input means for providing a signal;

housing means having at least two walls;

a plurality of resonator rods for providing a predetermined resonance, the first end of each resonator rod being mounted to one of said two housing walls, the second end of each resonator rod having a recess axially disposed therein;

alignment means disposed between the second ends of said resonator rods and the other of said two housing walls for supporting said resonator rods and for providing capacitance between said housing wall and said resonator rod, said plurality of alignment means each having an opening between said housing wall and said resonator rods; and tuning means incrementally insertable through said housing wall, said alignment means and said recess at the second end of said plurality of resonator rods for adjusting the capacitance between said housing wall and said plurality of resonator rods and for adjusting the resonance of said resonator rods.

* * * * *